US008038192B2

(12) United States Patent
Claypool et al.

(10) Patent No.: US 8,038,192 B2
(45) Date of Patent: Oct. 18, 2011

(54) TWO-HANDED ICE SCOOP

(75) Inventors: Christopher J. Claypool, Huntersville, NC (US); Jason Ernest Begin, Mooresville, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 378 days.

(21) Appl. No.: 12/324,240

(22) Filed: Nov. 26, 2008

(65) Prior Publication Data

US 2009/0167038 A1 Jul. 2, 2009

Related U.S. Application Data

(60) Provisional application No. 60/990,482, filed on Nov. 27, 2007.

(51) Int. Cl.
*A47F 13/08* (2006.01)

(52) U.S. Cl. ..... 294/178; 294/58; 294/180

(58) Field of Classification Search ..... 294/54.5, 294/55, 57, 58, 56, 25; 141/391
See application file for complete search history.

(56) References Cited

U.S. PATENT DOCUMENTS

| | | | | | |
|---|---|---|---|---|---|
| 247,449 | A | | 9/1881 | Webster et al. | |
| 258,260 | A | * | 5/1882 | Staples | 37/265 |
| 557,988 | A | | 4/1896 | Gageby | |
| 1,182,412 | A | | 5/1916 | Olesberg | |
| 1,212,305 | A | * | 1/1917 | Worsell | 294/55 |
| 1,774,027 | A | | 8/1930 | Martenson | |
| 2,318,277 | A | | 5/1943 | Yensen | |
| D142,480 | S | | 10/1945 | Hopkins | |
| 2,629,624 | A | | 2/1953 | Nelles | |
| 2,823,470 | A | * | 2/1958 | Page | 37/265 |
| 2,933,836 | A | * | 4/1960 | McKinley | 37/265 |
| 3,136,574 | A | * | 6/1964 | Pasquale | 294/54.5 |
| 3,371,694 | A | * | 3/1968 | Miller | 269/289 R |
| 3,436,111 | A | | 4/1969 | England | |
| 3,751,058 | A | | 8/1973 | Larsen | |
| 4,194,778 | A | | 3/1980 | Hodnett | |
| 4,640,540 | A | * | 2/1987 | Chisholm | 294/55 |
| 5,159,769 | A | * | 11/1992 | Odorisio | 37/278 |
| 5,395,147 | A | | 3/1995 | Brown et al. | |
| D359,892 | S | | 7/1995 | Isbell, Sr. | |
| D377,300 | S | | 1/1997 | Fredrick von Essen | |
| D383,582 | S | | 9/1997 | Sinclair | |
| 5,782,518 | A | * | 7/1998 | Scruggs | 294/57 |

(Continued)

OTHER PUBLICATIONS

Traex Ice Scoops; p. 101;Libbey Foodservice Sep. 2008 Catalog; 3 pages; Aug. 2008.

*Primary Examiner* — Dean Kramer
(74) *Attorney, Agent, or Firm* — Lempia Summerfield Katz LLC

(57) ABSTRACT

An ice scoop is disclosed and has a scoop section and a handle section. The scoop section includes a bottom with a forward end, a rear end, and opposed side edges, two opposed side walls extending up from the side edges of the bottom, and a back wall connecting the side walls and connected to the rear end of the bottom. A scoop cavity is defined within the scoop section. The handle section extends rearward from the back wall and has two elongate, opposed, and spaced apart rails. First and second grips extend laterally between the two rails. The first grip is spaced from the back wall. The second grip is spaced from the first grip further from the back wall. The handle section is oriented at an oblique angle relative to the bottom and angles upward away from the back. The handle has an offset step formed in the side rails. The forward end is a reinforced edge. The scoop has a hand shield at the back wall and spaced from the first grip.

23 Claims, 5 Drawing Sheets

U.S. PATENT DOCUMENTS

| | | | | |
|---|---|---|---|---|
| D405,665 | S | 2/1999 | Whitehead et al. | |
| 5,887,919 | A | 3/1999 | Sallinen et al. | |
| D440,729 | S | 4/2001 | Piner et al. | |
| D445,235 | S | 7/2001 | Gibson | |
| 6,378,577 | B1 | 4/2002 | Piner et al. | |
| 6,592,160 | B1 * | 7/2003 | Nicolay et al. | 294/57 |
| D496,233 | S | 9/2004 | Young et al. | |
| D506,111 | S | 6/2005 | Handley | |
| D533,418 | S | 12/2006 | Agazzi | |
| D568,680 | S | 5/2008 | Hsu | |
| 2005/0035611 | A1 | 2/2005 | Agazzi et al. | |
| 2005/0151384 | A1 | 7/2005 | Omdoll et al. | |

* cited by examiner

TWO-HANDED ICE SCOOP

CROSS REFERENCE TO RELATED APPLICATION

This application claims the benefit of U.S. Provisional Patent Application Ser. No. 60/990,482, filed on Nov. 27, 2007, the disclosure of which is incorporated herein by reference.

BACKGROUND OF THE INVENTION

1. Field of the Disclosure

The present disclosure is generally directed to scoops, and more particularly to a scoop with a handle with two grips.

2. Description of Related Art

Ice scoops and other such scooping devices are known in the art. Most of these devices are smaller devices for use with one hand. Such devices are typically limited as to the amount of ice or other food product that can be scooped and carried per scoop-full. Because these devices are also operated using only one hand, a user may not be able to easily break ice chunks or plow through a large volume of ice when inserting the scoop into a large container of ice. One handed scoops also can require more reaching and bending for the user when scooping.

A two-handed product is known for scooping ice within a commercial kitchen environment. However, this device is essentially identical to a conventional shovel, but is smaller and made of molded plastic. The device has a linear elongate handle and a shallow shovel head, One problem with such a device is that, when transferring larger amounts of ice from an ice machine to a bucket or container, lots of ice tends to spill from the shovel head and hit the surrounding floor. Melted ice on a floor of a commercial kitchen can create a safety hazard. This also results in wasted ice. Another problem with the known shovel-like device is that the mouth or leading edge of the shovel head is very wide, making it awkward or difficult to insert into ice machines with smaller openings. Yet another problem is that the sides of the shovel head are shallow and do not readily contain large amounts of scooped ice or other food product. Additionally, the handle angle, which generally extends horizontally rearward from the shovel head, is awkward for shoveling ice out of ice machines. A user cannot adequately operate the shovel-like device from a comfortable, efficient angle, and cannot get a good grip on the handle when inserting the shovel head into the ice. A user may try a variety of hand positions, thereby increasing the possibility of cross contamination. Also, the front edge of this known shovel-like device has a thin, knife-like leading edge. When the leading edge is shoved into the ice, the leading edge may be cut, chipped, or damaged. Over time, this can reduce the shovel's effectiveness and can potentially result in plastic chips and fragments being left behind in the ice.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed two-handed scoop solves or improves upon one or more of the above noted and/or other problems and disadvantages with prior art ice scoops of this type. In one example, the disclosed two-handed scoop includes an ergonomically comfortable handle with two grips positioned relative to one another and to the scoop section so that a user can comfortably and easily manipulate the scoop. In another example, the two-handed scoop disclosed herein provides a more comfortable angled handle allowing a user to scoop more ice and yet easily manipulate the filled scoop. In another example, the disclosed two-handed scoop handle is shaped to easily permit the scoop section to be inserted into the contents to be scooped while maintaining a relatively comfortable body, arm, and hand position. In another example, the disclosed two-handed scoop includes a hand shield or guard to assist in preventing a user's hand from coming into contact with the ice or other product to be scooped during use. In another example, the sides and back of the scoop section are taller and slanted to increase the amount of ice or other material to be scooped without spilling and while being easily manipulated and lifted by the user. In another example, the disclosed two-handed scoop includes a scoop section that narrows toward its forward end to assist a user in emptying and directing the contents of the scoop to a desired container.

Figures 1, 2, 3:
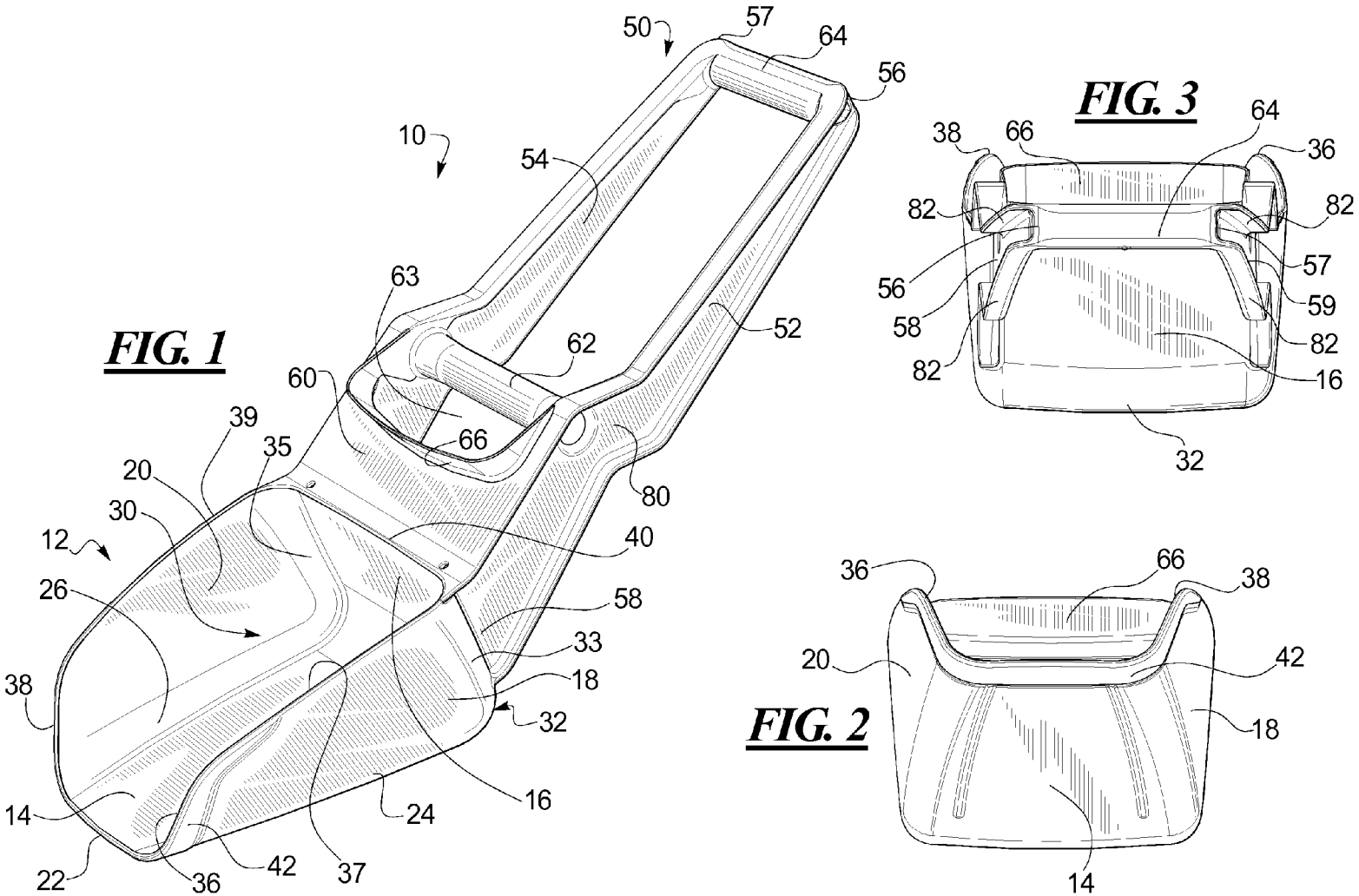
FIG. 1 shows a front perspective view of one example of a two-handed scoop constructed in accordance with the teachings of the present invention.
FIG. 2 shows a rear elevational view of the two-handed scoop in FIG. 1.
FIG. 3 shows a front elevational view of the two-handed scoop in FIG. 1.

Referring now to the drawings, FIGS. 1-5 illustrate various views of one example of a two-handed scoop 10 constructed in accordance with the teachings of the present invention. In the disclosed example as shown in FIG. 1, the scoop 10 generally includes a scoop bucket or scoop section 12 and a handle section 50 extending from the scoop section. In the present example, the handle section 50 and the scoop section 12 can be integrally molded with one another of a polycarbonate material. In another example, the handle and the scoop section need not be integrally molded, but instead can be formed separately and joined by other known means such as screws or other fastening techniques. In another example, the ice scoop can be made of alternate materials such as other types of plastic or metal, or a combination of suitable materials.

Figure 5:
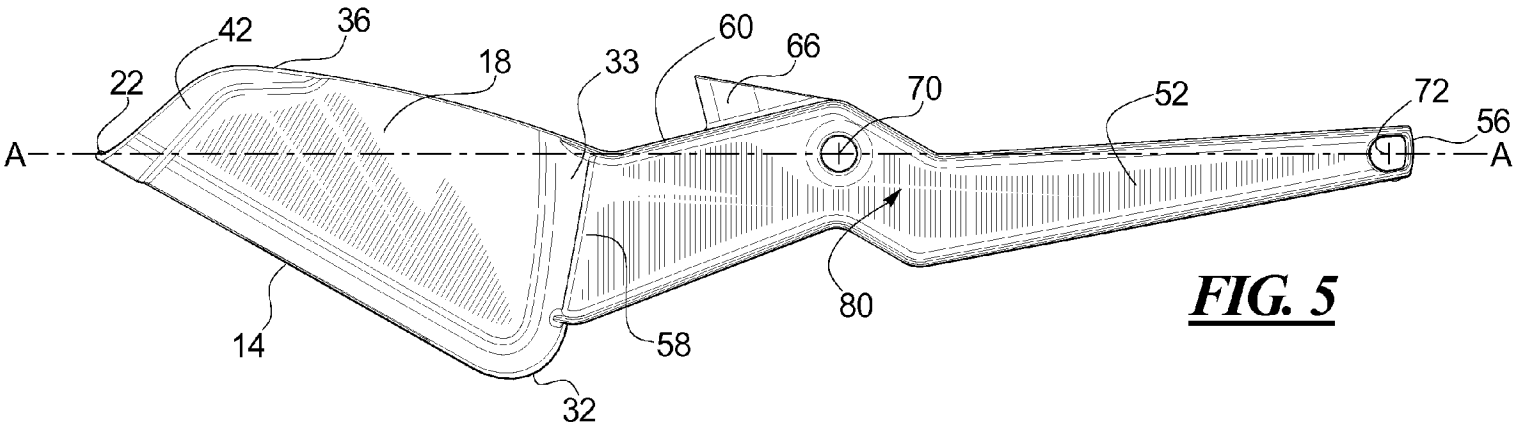
FIG. 5 shows a side elevational view of the two-handed scoop in FIG. 1.

The scoop section 12 in this example includes a bottom wall 14, a back wall 16, and a pair of opposed side walls 18, 20. The bottom wall 14 has a front end or leading edge 22, two opposed side edges and a rear edge. Each side wall 18, 20 joins to and extends upward from a side edge of the bottom wall 14, respectively. The integral connections or joints 24, 26 between the side edges and the side walls 18, 20 are curved. The integral connection or joint 28 between the rear edge of the bottom wall 14 and the back wall 16 is also curved. As shown in FIGS. 1 and 5, an outside surface of the bottom wall 14 and an outside surface of the back wall 16, meet at the rear joint 28 and form a curved connecting heel portion 32 of the scoop section 12. The back wall 16 spans laterally between the side walls 18, 20 and connects thereto, also at curved connections or joints 33, 35, respectively. The back wall 16 can be obliquely angled or tilted forward so that its upper edge 40 is slightly closer to the leading edge 22 of the scoop bottom 14. The bottom 14, back wall 16, and side walls 18, 20 so joined form an interior scoop cavity 30 of the scoop section 12. The interior cavity 30 of the scoop section 12 has no sharp corners and is smoothly contoured. This can avoid sharp recesses which can trap contaminants and be difficult to clean.

Figure 4:
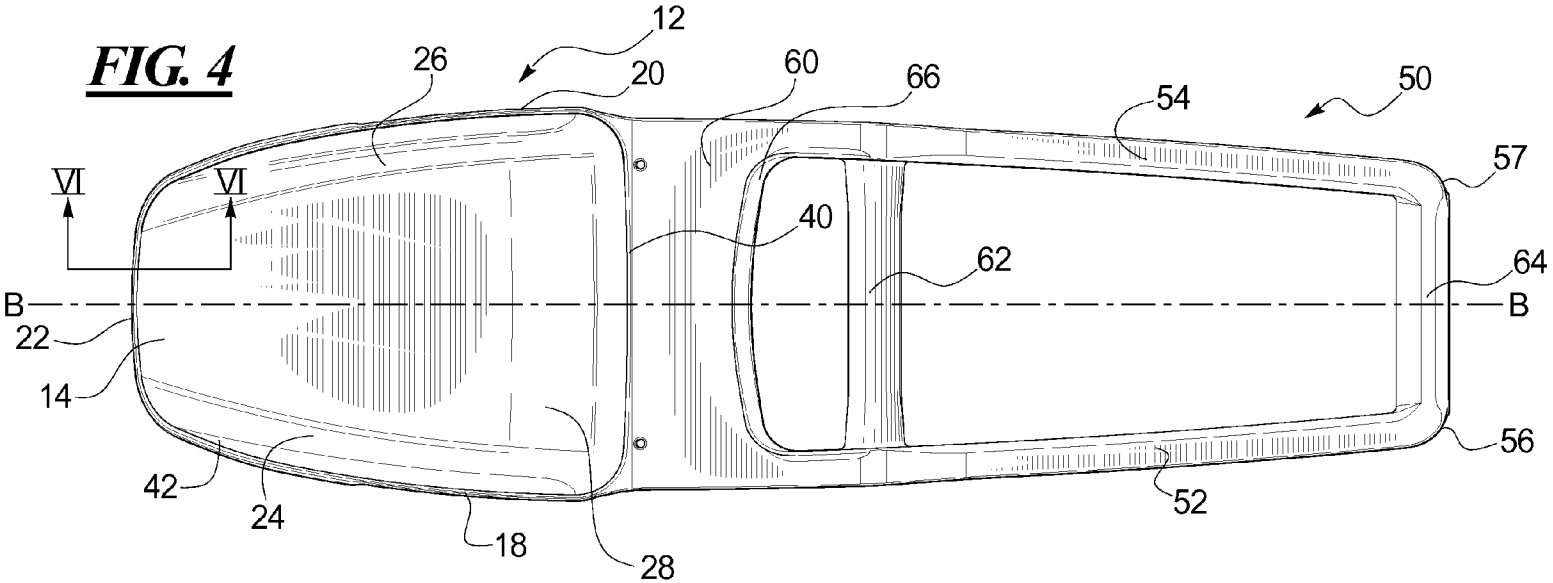
FIG. 4 shows a top plan view of the two-handed scoop in FIG. 1.

As illustrated in the top plan view of FIG. 4, the scoop section 12 has an open front and an open top. The leading edge 22, forward edges 36, 38 of the side walls 18, 20, upper edges 37, 39, and the upper edge 40 of the back wall form a periphery around the open front and front of the scoop section 12 and define the scoop cavity 30. The side walls 18, 20 become increasingly taller moving away from the leading edge 22. The side walls 18, 20 also converge toward one another nearer the leading edge 22. This creates a narrowed mouth between the forward edges 36, 38. The forward edges 36, 38 of the side walls are closer to one another than are respective joints 33, 35 of the back wall 16.

Figure 6:
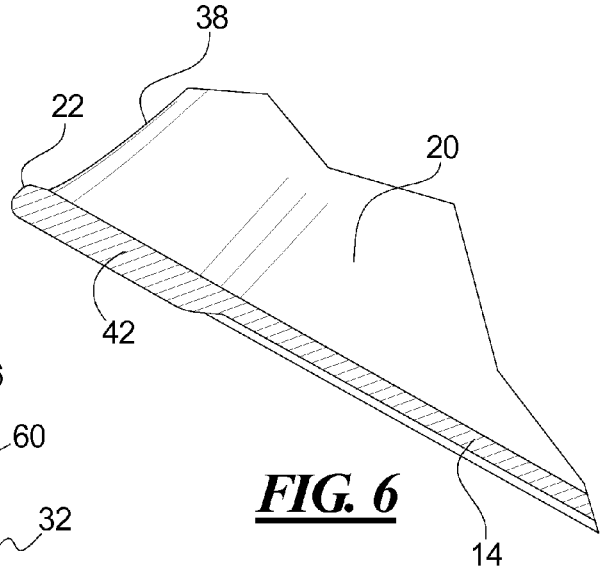
FIG. 6 shows an enlarged detailed section of a front end of the two-handed scoop and taken along lines VI-VI in FIG. 4.

As shown in FIGS. 2 and 5, the leading edge 22 of the bottom wall 14, the forward edges 36, 38 of the side walls 18, 20 and a front part of the top edges 33, 35 of the side walls 18, 20 include an integral thicker region 42 creating a reinforced area at the working end of the scoop section 12. As shown in FIG. 6, the thicker region 42 tapers or transitions smoothly into the thinner wall thickness of the bottom wall 14 and side walls 18, 20. This can avoid sharp corners, and allow easy cleaning and avoid contamination.

The shape and relation of the bottom wall 14, the side walls 18, 20, and the back wall 16 can vary from the example shown and still remain within the teachings of the present invention. For example, the opposed side walls 18, 20 need not converge toward the leading edge 22 if a narrowed mouth is not preferred. The thickness and boundaries of the reinforced region 42 can vary. The height of the side walls and back wall can also vary, as can the incline angle of the back wall.

As shown in FIGS. 1, 4, and 5, the two-handed scoop 10 also has an elongate handle section 50 extending rearward from the back wall 16 of the scoop section 12. The handle section 50 in this example includes a pair of spaced apart handle rails, supports, or braces 52, 54 joined to the back wall 16 and extending rearward therefrom. Each of the side rails 52, 54 terminates at a distal end 56, 57, respectively. A forward or first grip or handhold 62 extends transversely between the two side rails 52, 54 and is spaced from the back wall 14. The distal ends 56, 57 are interconnected by a rearward second grip or handhold 64 of the handle section 50 that also extends transversely to the side rails 56, 57. The second grip 64 is spaced from the first grip 62 and is further removed from the back wall 16. The first and second grips 62, 64 thus provide two separate and independent hand grips on the handle section 50.

As shown in FIGS. 1 and 4, a hand shield 60 extends upward and rearward from the upper edge 40 of the back wall 16 of the scoop section 12. The hand shield 60 is also connected to a top edge of respective proximal ends 58, 59 of the handle rails 52, 54. The hand shield 60 extends rearward along the side rails 52, 54 a distance from the back wall 16 part way to the first handhold 62. The hand shield 60 has a flange extension or knuckle guard 66 approximately perpendicular to the handle rails 52, 54 and along the free edge adjacent an opening 63 between the shield 60 and the first handhold 62. The knuckle guard 66 extends upward normal to the hand shield 60 and is spaced from the first handhold 62.

With reference to FIG. 5 in this example, the leading edge 22 of the scoop section 12 is aligned with the forward or first handhold 62 and the rearward or second handhold 64 along a common plane A-A. Also in this example, the first handhold 62 is located at about a midpoint relative to the entire length of the scoop 10 between the leading edge 22 and the second handhold 64. As shown in FIG. 4, the handle and scoop are side to side symmetrical relative to the axis B-B.

The handle rails 52, 54 in this example taper in height slightly from the proximal end 58, 59 to the distal end 56, 57. Also, the second handhold 64 is narrower in width than the first handhold 62 causing the entire handle section 50 to taper slightly moving away from the back wall 16 of the scoop section 12. As can be seen in FIG. 3, in cross-section, each rail 52, 54 is a C-channel section for structural rigidity. A typical C-channel has a center web (i.e., the rails 52, 54) and a flange 82 at the top of the web and at the bottom of the web. The flanges 82 of each side rail 52, 54 C-channel are oriented extending outward in the same direction. Each rail 52, 54 is a minor image of the other. The cross-sectional shape and overall configuration of the side rails can vary while remaining sufficiently rigid.

As stated above, and as shown in FIGS. 1, 4, and 5, the scoop section 12 and the handle section 50 are joined at the back wall 16. Each side rail 52, 54 is integrally connected near a respective joint 33, 35 to the back wall 16. As can be seen in FIGS. 1 and 3, the flanges 82 and vertical web of the rails 52, 54 transition smoothly into the structure of the scoop section 12.

In the disclosed example, each of the side rails 52, 54 includes an offset stepped or jogged section 80 in close proximity to the forward handhold 62 and between the handholds The angle of the handle section 50 is not constant over its length and is not aligned with the plane A-A or the bottom 14. A major portion of the rails 52, 54 is disposed below the common plane A-A when the scoop 10 is viewed from the side. The handle section 50 projects from the back wall 16 at an upwardly acute oblique angle relative to the back wall 16. In proximity to the first handhold 62, the rails 52, 54 then step or jog approximately parallel relative to the bottom 14 and below the plane A-A within the stepped region 80. The rails 52, 54 then bend or jog in the reverse direction back to a shallower oblique angle relative to the bottom 14. The rails 52, 54 continue from the stepped region 80 to meet the second handhold 64 at the plane A-A.

The disclosed two-handed scoop 10, and particularly the arrangement of the various portions of the handle section 50, and the relative relationship between the handle section 50 and the scoop section 12 provides a scoop with much improved ergonomics. The overall length of the scoop 10 can be shorter than the conventional plastic shovel known in the art and described above. The scoop 10 can also move more ice or other product than a conventional one-handed scoop. Testing has shown that a user can fill a standard ice tote in half as many scoops as a standard scoop. Further, the two grips 62, 64 are parallel to one another, but oriented perpendicular to the axis of the scoop section 12 and handle section 50. The grips 62, 64 and are also aligned inside view along the plane A-A with one another and the leading edge 22 of the scoop section 12. These features allow a user to get a better grip on the scoop 10 while scooping up contents and allow a user to apply more force with less effort in digging into the contents.

The thickened front edge 42 of the scoop section 12 creates a strong leading edge 22 on the scoop 10. This leading edge 22 can help in breaking up ice chunks that have melted together and yet inhibit chipping and damage to the leading edge of the two-handed scoop. By inhibiting chipping, small plastic or other material particles are inhibited from becoming dislodged from the scoop and contaminating the product being scooped. The user can apply greater force using the reinforced leading edge to better break up the ice chunks, because the leading edge and the handle axis are aligned in the same plane and because the thicker leading edge can withstand greater punishment during use. Additional force can be particularly useful when a user is trying to scoop ice which has melted and refrozen into large chunks.

Figure 7:
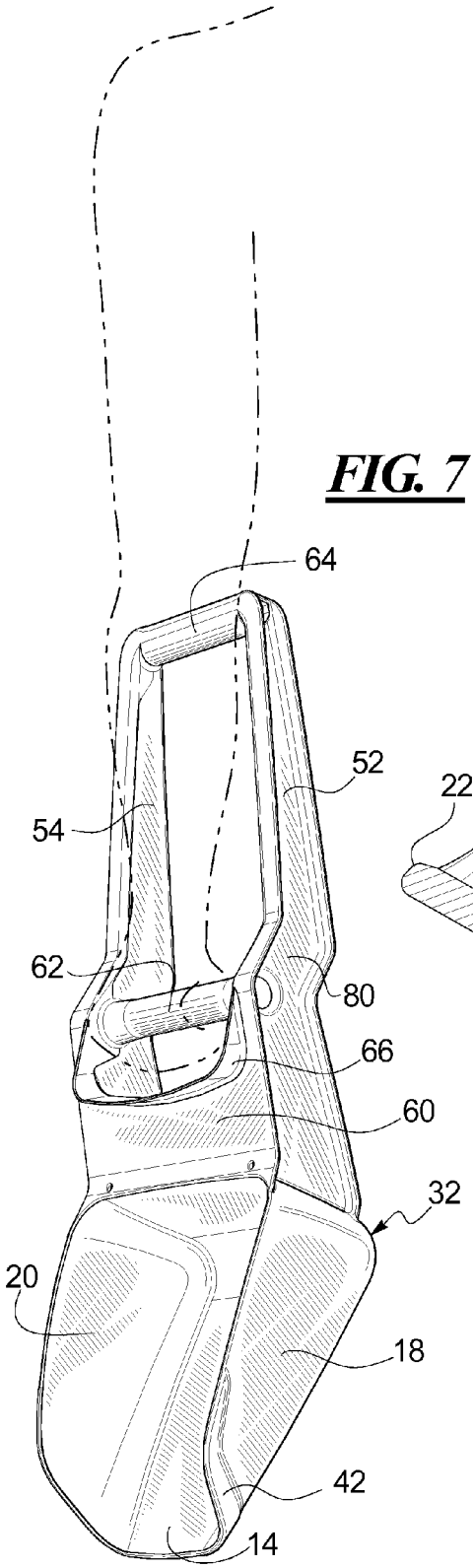
FIG. 7 shows an example of the two-handed scoop represented in FIG. 1 and being held with one hand by a user.

As noted above, the offset step 80 in the handle section 50 profile shown in FIG. 5 also provides better ergonomics for the user. First, the offset region realigns the second handhold on the plane A-A, even thought the handle section 50 is oriented at an oblique angle relative to the scoop section 12. With reference to FIG. 7, the stepped region 80 also creates a comfortable, unencumbered resting area for the user's arm extending from the first grip 62 to the second grip 64. This angled handle allows the individual to hold the scoop 10 downward along the side of their body with the handle section 50 tucked under their armpit without having to bend their arm awkwardly. The offset stepped region 80 in proximity to the forward grip 62 creates clearance for a user's arm and hand so that the user can comfortably carry and manipulate the device even with one hand, if needed.

Figures 8, 9:
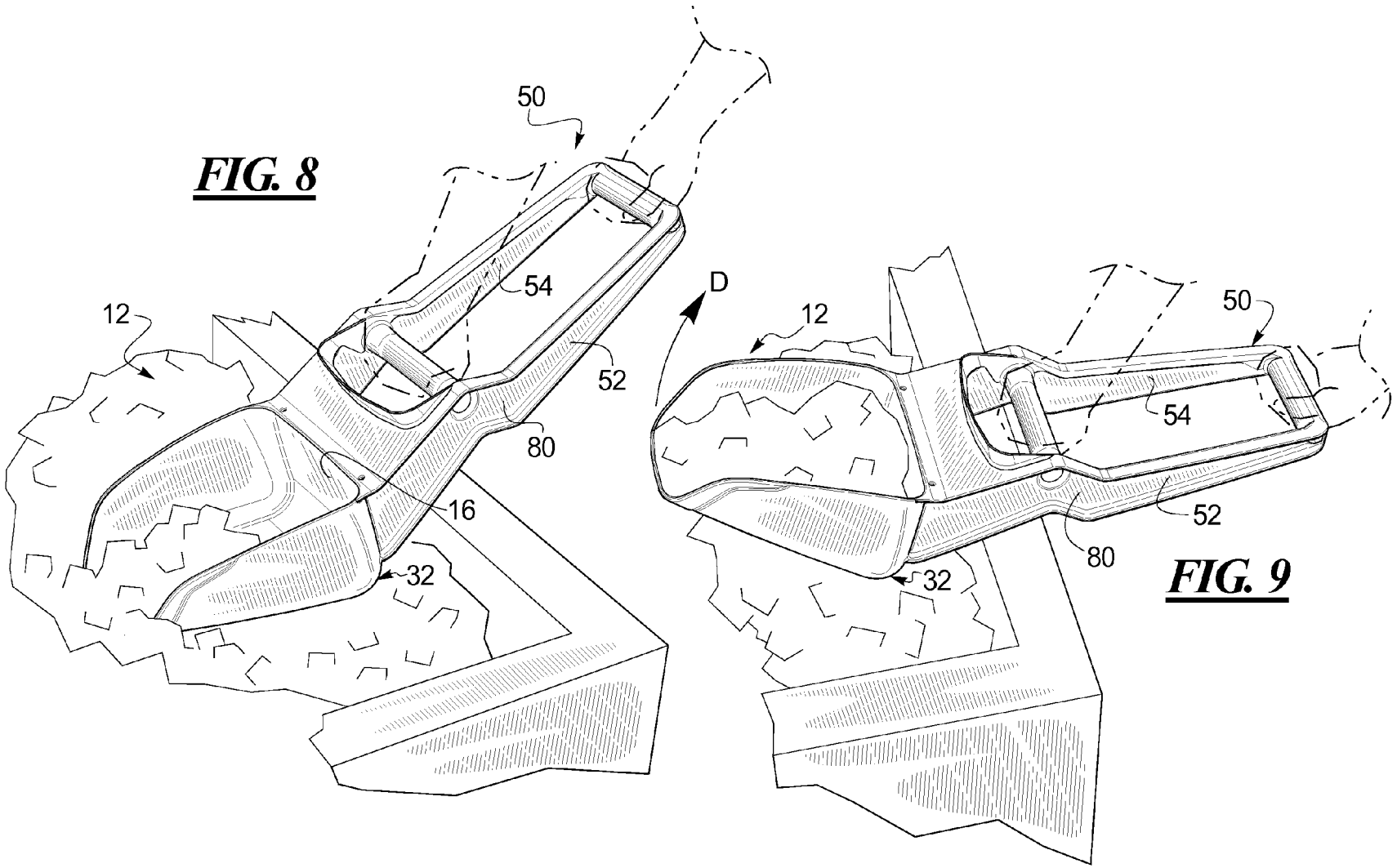
FIG. 8 shows the two-handed scoop in FIG. 6 during use.
FIG. 9 shows the two-handed scoop in FIG. 8 after scooping ice.
Figure 10:
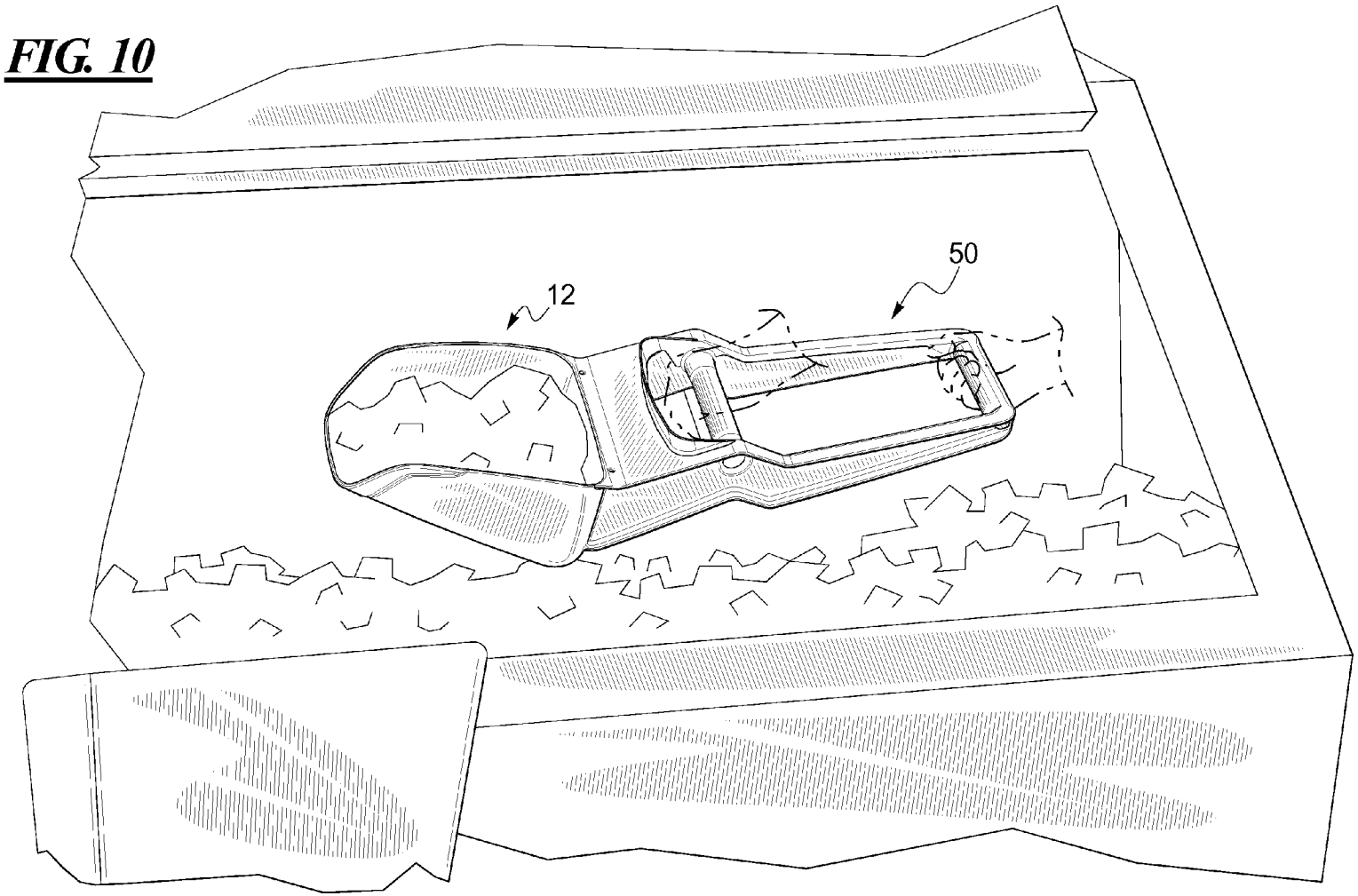
FIG. 10 shows another view of the two-handed scoop in FIG. 6 during use.

The offset region 80 in the side rails 53, 54 of the handle section 50 also allows clearance for a user's arm while using the scoop 10 as is shown in FIGS. 8-10. The offset or step region 80 avoids awkward motion and arm angles, resulting in better performance of the two-handed scoop 10 during use. The improved ergonomics also allow a user to more easily manipulate the two-handed scoop in smaller environments, such as in an ice machine with a relatively small entry opening. The offset region 80 also allows for sturdy, robust sized side rails without hindering the ergonomic benefits of the two-handed scoop. Arrow D in FIG. 9 illustrates the direction of the arcing motion executed during scooping and filling of the scoop section 12.

Aligning the leading edge 22 and the grips 62, 64 along the common plane A-A while having an offset in the side rails 52, 54, results in essentially a one-to-one transfer of load exerted on the handles to the leading edge during use. The plane A-A alignment also minimizes any bending moment applied to the device during use. This can reduce the likelihood of the scoop 10 breaking when jammed hard into a large container of ice as well as permit substantial effort to break ice chunks and the like. As can be seen in FIG. 5, the offset region 80 and the handle section 50 position on the scoop section 12 further allows the bottom of the scoop section 12 to be angled downward toward the heel 32 mostly below the plane A-A. This can maximize the carrying capacity of the scoop 10 while being manipulated by a user.

Also with reference to FIGS. 5 and 8-10, the position of the lower edge of the handle section 50 relative to the back wall 16 and the bottom 14 of the scoop section 12 of the scoop 10 creates clearance right behind the scoop section 12. This clearance can allow a user to more deeply insert or embed the two-handed scoop 10 into ice or other material to be collected without hitting their knuckles on the ice or other material, as can be seen with particular reference to FIGS. 8 and 9. When the heel 32 is in the ice container, the angle of the rails 52, 54 relative to the back wall 16 allows a user's hands to remain higher than the level of the ice in the container.

The narrower front opening or mouth of the scoop section 12 permits a user to more accurately pour or deposit the contents held within the scoop section 12 into other containers. Sometimes these containers can have a relatively small access or insertion opening. Utilizing the disclosed tapered scoop 10 may allow a user to more easily and accurately transfer material from the two-handed scoop 10 into such other containers while avoiding spilling ice or other contents onto the floor.

The two grips 52, 54 being arranged in a parallel orientation and perpendicular to the length of the scoop 10 allow a user to easily scoop in a lateral across-the-body motion. Such a motion is suited to openings in conventional commercial ice machines and can aid a user in avoiding excessive bending and awkward reaching positions during use. The scoop 10, including the two transverse handholds, can be awkward to manipulate if not held properly during use. Thus, a user will be more likely to hold the scoop 10 by the designated handles. Proper use will help to avoid of cross contamination during use.

The increasing height of the side walls 18, 20 and the forwardly tilted back wall 16 provide the advantage of being able to load and carry more ice or other product with less likelihood of spilling the contents while transferring the product. As shown in FIG. 5, when the reference plane A-A of the scoop 10 is held level, the contents of the scoop section 12 would be tilted back into the cavity 30. This makes it easier to hold and carry the scoop 10 without spilling. The user can insert the scoop section 12 of the two-handed scoop 10 disclosed herein, retrieve relatively large amounts of ice or other such product, and then easily transfer that product to another location and another container with a significantly lowered likelihood of spilling the contents.

The smoothly curved contours of the scoop section 12 allow the scoop 10 to easily slide through ice or other food products. Smooth contours aid in reducing friction and fatigue in a user. The smooth contours also improve the cleanability/washability of the scoop.

With reference to FIGS. 1-5, the forward handhold 62 is positioned behind and spaced from the hand shield 60. The hand shield 60 can protect a user's hand from hitting the ice as well as prevent their hand from contaminating the ice via contact with the ice being scooped. The hand shield 60 can assist in avoiding contamination of the food product during transfer as well.

In the disclosed example, the two-handed scoop 10 can be formed of an injection molded polycarbonate resin and include a plurality of injection molded structural webs, ribs, and the like to provide strength and rigidity to the product. Polycarbonate material is a preferred material for its resistance to thermal fatigue, thus rendering the scoop 10 suitable for dishwasher cleaning. Furthermore, the color can be translucent blue to denote ice functionality, and enhance the ability of a user to see any dirt or contamination. The grips can be molded integrally with the remainder of the shovel, or can be formed separately and attached to the handle rails if desired. Also, both the intermediate and more remote grips can include a dual-molded or over-molded surface of a different material to provide a better more comfortable grip for the user. However, the disclosed invention is not intended to be limited to any specific material or fabrication process.

Commercial ice bins often have a dam that holds back an amount of ice for scooping. A vertical height between the bin and the dam is, on average, about nine to ten inches. The width of the disclosed scoop 10 can be eight inches to allow a user to insert the scoop section 12 into the space and reach the ice using a sideways scooping motion if necessary. The relative size of the scoop allows it to fit within commercial dishwashers for sanitizing and reducing the likelihood of contamination.

Though the scoop disclosed herein is particularly useful for scooping ice from a commercial ice machine, the scoop can be utilized for scooping virtually any product from its container and yet achieve the benefits associated with the disclosed two-handed scoop. The disclosed two-handed scoop provides a number of benefits and advantages over prior known devices.

Although certain scoops and features have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An ice scoop comprising:

a scoop section having a bottom wall with a forward end, a rear end, and opposed sides, two opposed side walls extending up from the sides, and a back wall extending between the side walls and up from the rear end of the bottom wall; and a handle section extending rearward from the back wall and having two opposed and spaced apart rails, a first handhold extending laterally between the two rails and spaced from the back wall, and a second handhold extending laterally between the two rails and spaced from the first handhold and farther from the back wall, wherein the handle section is oriented at an oblique angle relative to the bottom wall and angles upward further away from the back wall, and wherein the two rails have an offset step in close proximity to the first handhold and between the first and second handholds, and wherein the offset step is downward relative to the handle section angle and in the direction away from the scoop section when viewed from the side.

2. An ice scoop according to claim 1, further comprising a reinforced region along the forward end of the bottom wall and extending upwardly along a front edge of each side wall, the reinforced region including a wall thickness greater than an adjacent wall thickness of the bottom and side walls.

3. An ice scoop according to claim 1, wherein the first handhold and the second handhold are generally parallel to one another.

4. An ice scoop according to claim 1, wherein the forward end of the bottom, the first handhold, and the second handhold are aligned along a common lengthwise plane when viewed from the side.

5. An ice scoop according to claim 1, wherein the first handhold is located at about a midpoint relative to the entire length of the ice scoop between the forward end and the second handhold.

6. An ice scoop according to claim 1, wherein the handle section and the scoop section are integrally formed with one another of a polycarbonate material.

7. An ice scoop comprising:

a scoop section having a bottom wall with a forward end, a rear end, and opposed sides, two opposed side walls extending up from the sides, and a back wall extending between the side walls and up from the rear end of the bottom wall;

a handle section extending rearward from the back wall and having two opposed and spaced apart rails, a first handhold extending laterally between the two rails and spaced from the back wall, and a second handhold extending laterally between the two rails and spaced from the first handhold and farther from the back wall; and a hand shield extending upwardly from an upper edge of the back wall of the scoop section and extending between the rails, a free edge of the hand shield terminating between and spaced from the first handhold and the back wall, wherein the handle section is oriented at an oblique angle relative to the bottom wall and angles upward further away from the back wall.

8. A scoop comprising:

a scoop section having a bottom wall with a leading edge, a rear end, and opposed side edges, two opposed side walls extending up from the side edges, and a back wall disposed between the sides and extending up from the rear end of the bottom wall; and a handle section extending rearward from the back wall and having two opposed and spaced apart rails, a forward handhold extending laterally between the two rails and spaced from the back wall, and a rearward handhold extending laterally between the two rails and spaced from the forward handhold and farther from the back wall;

a hand shield extending from the back wall toward the forward handhold and terminating short of the forward handhold; and wherein the leading edge and the forward and rearward handholds are positioned along a common lengthwise plane from the leading edge through the rearward handhold, and wherein the handle section has an offset from the common plane; and wherein the side walls are closer to one another at the leading edge than at the back wall,

9. A scoop according to claim 8, wherein the leading edge is reinforced and includes a thickened region along leading edge of the bottom wall and extending upwardly along a front peripheral edge of each side wall respectively.

10. A scoop according to claim 8, wherein the forward handhold and the rearward handhold are generally parallel to one another and are oriented transversely between the two rails.

11. A scoop according to claim 8, wherein the common plane is oriented at an oblique angle relative to the bottom wall of the scoop section and at an angle upward relative to the bottom wall further away from the leading edge.

12. A scoop according to claim 8, wherein the forward handhold is positioned at about a midpoint between the leading edge and the rearward handhold.

13. A scoop, comprising:

a scoop section having a bottom wall with a leading edge, a rear end, and opposed side edges, two opposed side walls extending up from the side edges, and a back wall disposed between the sides and extending up from the rear end of the bottom wall; and a handle section extending rearward from the back wall and having two opposed and spaced apart rails, a forward handhold extending laterally between the two rails and spaced from the back wall, and a rearward handhold extending laterally between the two rails and spaced from the forward handhold and farther from the back wall; and wherein the leading edge and the forward and rearward handholds are positioned along a common lengthwise plane from the leading edge through the rearward handhold, and wherein the handle section has an offset from the common plane, wherein the side walls are closer to one another at the leading edge than at the back wall, and wherein the two rails taper toward one another closer to the rearward handhold.

14. A scoop according to claim 13, wherein the leading edge is reinforced and includes a thickened region along leading edge of the bottom wall and extending upwardly along a front peripheral edge of each side wall respectively.

15. A scoop according to claim 13, wherein the forward handhold and the rearward handhold are generally parallel to one another and are oriented transversely between the two rails.

16. A scoop according to claim 13, wherein the common plane is oriented at an oblique angle relative to the bottom wall of the scoop section and at an angle upward relative to the bottom wall further away from the leading edge.

17. A scoop according to claim 13, wherein the forward handhold is positioned at about a midpoint between the leading edge and the rearward handhold.

18. A scoop according to claim 13, further comprising a hand shield that extends from the back wall toward the forward handhold and terminates short of the forward handhold.

19. A scoop comprising:

a scoop section having a bottom, a leading edge, two side walls extending up from opposed edges of the bottom, and a back wall extending between the side walls and up from a rear end of the bottom opposite the leading edge; and a handle section extending rearward from the back wall and having two opposed and spaced apart rails, a first handhold extending laterally between the two rails and spaced from the back wall, and a second handhold extending laterally between the two rails and spaced from the first handhold and farther from the back wall, wherein the scoop section has a thicker reinforced region along the leading edge and extending upwardly along a front edge of each side wall, wherein the scoop section has a hand shield extending from an upper edge of the back wall between the rails and toward the first handhold, and wherein the scoop section further comprises a knuckle guard extending upward and normal to the hand shield along a free edge of the hand shield spaced from the first handhold.

20. A scoop according to claim 19, wherein a center of the leading edge, a center of the first handhold, and a center of the second handhold are in alignment along a common plane.

21. A scoop according to claim 19, wherein the two rails of the handle section have an offset step downward when viewed from the side and oriented generally parallel to the bottom.

22. A scoop according to claim 19, wherein the leading edge, an axis of the first handhold, and an axis of the second handhold lie generally in a common plane when viewed from the side, and wherein the common plane is oriented at an oblique angle relative to the bottom of the scoop section and is angled in an upward direction relative to the bottom wall farther away from the leading edge.

23. A scoop according to claim 19, wherein the first handhold is located at about a midpoint relative to the entire length of the scoop between the leading edge and the second handhold.

* * * * *